US008027498B2

(12) United States Patent
Tsai et al.

(10) Patent No.: US 8,027,498 B2
(45) Date of Patent: Sep. 27, 2011

(54) SPEAKER CAPABLE OF EMITTING LIGHT

(75) Inventors: Chu-Chia Tsai, Taipei Hsien (TW); Wen-Chi Chen, Taipei Hsien (TW); Lai-Shi Huang, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 1132 days.

(21) Appl. No.: 11/766,069

(22) Filed: Jun. 20, 2007

(65) Prior Publication Data

US 2008/0199036 A1 Aug. 21, 2008

(30) Foreign Application Priority Data

Feb. 16, 2007 (TW) ..... 96106285 A

(51) Int. Cl.
*H04R 1/02* (2006.01)

(52) U.S. Cl. ..... 381/333; 381/388

(58) Field of Classification Search ..... 381/333, 381/386, 388; 181/171, 172
See application file for complete search history.

(56) References Cited

U.S. PATENT DOCUMENTS

| | | | | |
|---|---|---|---|---|
| 6,270,229 | B1 * | 8/2001 | Chien | 362/84 |
| 7,167,573 | B2 * | 1/2007 | Williamson | 381/398 |
| 2002/0047569 | A1 * | 4/2002 | Dowling et al. | 315/169.3 |

FOREIGN PATENT DOCUMENTS

| | | | |
|---|---|---|---|
| CN | 2409736 | Y | 12/2000 |
| CN | 1701625 | A | 11/2005 |

OTHER PUBLICATIONS

Office action mailed on Apr. 20, 2011 for the China application No. 200710085479.3, p. 3 line 4-28 and line 29-31, p. 4 line 8-35 and line 36-38.

* cited by examiner

*Primary Examiner* — Brian Ensey
(74) *Attorney, Agent, or Firm* — Winston Hsu; Scott Margo

(57) ABSTRACT

A speaker capable of emitting light includes a housing, a plurality of light generators, and a speaker core. The housing formed by material capable of conducting light, used as a speaker chamber of the speaker, has a first opening and a second opening. The plurality of light generators is formed nearby the second opening for generating light. The speaker core is set in the first opening of the housing for generating sound.

19 Claims, 6 Drawing Sheets

SPEAKER CAPABLE OF EMITTING LIGHT

BACKGROUND OF THE INVENTION

1. Field of the Invention

The present invention relates to a speaker capable of emitting light, and more particularly, to a speaker with a housing formed as a speaker chamber of the speaker and for conducting light generated by light generators, so as to have a function of emitting light.

2. Description of the Prior Art

With technological advancement, processing speeds of electronic devices become faster and faster, while sizes of the devices become smaller and smaller. Thus, generally speaking, the electronic devices nowadays already satisfy basic demands of consumers, such that more and more attention is paid to multimedia functions of the electronic devices. Taking computers for example, when basic calculation performance reaches basic requests of the consumers, multimedia effects of the computers become a focus for choosing such products. Among multimedia devices of computers, speakers are basic equipment, designed for generating sound originally, however, no longer satisfies consumers anymore. Therefore, except for generating sound, the speakers should have a function of emitting light, so as to attract consumers.

Please refer to FIG. 1, which is a cross-section diagram of a prior art speaker 10 with a function of emitting light. The speaker 10 includes a speaker chamber 110, a speaker core 120, a light pipe 130 and light emitting diodes (LED) D1 and D2. The speaker chamber 110 includes an opening 115 utilized for installing the speaker core 120. Functions of the speaker chamber 110 and the speaker core 120 are well known for those skilled in the art, and thus are not repeated here. The light pipe 130 is installed on the opening 115 of the speaker chamber 110, and is utilized for providing a light propagation path to conduct light emitted by the LEDs D1 and D2. Therefore, the speaker 10 not only generates sound by the speaker core 120, but also propagates and emits light by the light pipe 130 installed on the opening 115 of the speaker chamber.

Please proceed to FIG. 2, which is a schematic diagram of the light pipe 130 installed on the opening 115 of the speaker chamber. The light pipe 130 includes an acrylic ring 132, a reflector 134, a diffuser 136 and a circuit board 138. The acrylic ring 132 can be considered as a light carrier, and includes a first light reception terminal 1320 and a second light reception terminal 1325 for receiving light emitted by the LEDs D1 and D2 respectively. The reflector 134 and the diffuser 136 are respectively installed on the top and the bottom of the light pipe 130, which are utilized for propagating the light emitted by the LEDs D1 and D2 evenly, and the light propagation direction is as shown in FIG. 2. The circuit board 138 is utilized for attaching the LEDs D1 and D2 and for laying out related circuits. Moreover, the light pipe 130 can include a fixture (not shown in FIG. 2) for assembling the light pipe 130 on the speaker chamber. Since the light pipe 130 needs to be composed by the components mentioned above, the speaker 10 capable of emitting light has great thickness and occupies too much space, so that it is not suitable for current electronic devices with small sizes and light weight. Moreover, the light pipe 130 is composed of too many components, so that the production cost of the speaker 10 is high and the quality is not stable as well.

SUMMARY OF THE INVENTION

It is therefore a primary objective of the present invention to provide a speaker capable of emitting light.

The present invention discloses a speaker capable of emitting light. The speaker comprises a housing formed by material capable of propagating light comprising a first opening and a second opening, a plurality of light generators formed nearby the second opening of the housing for generating light, and a speaker core set in the first opening of the housing for generating sound.

The present invention further discloses a multimedia device with speakers capable of emitting light. The multimedia device comprises a multimedia processing system for processing multimedia signals and a plurality of speakers for outputting processing results of the multimedia processing system, wherein each speaker comprises a housing formed by material capable of propagating light having a first opening and a second opening, a plurality of light generators formed nearby the second opening of the housing for generating light, and a speaker core set in the first opening of the housing for generating sound.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
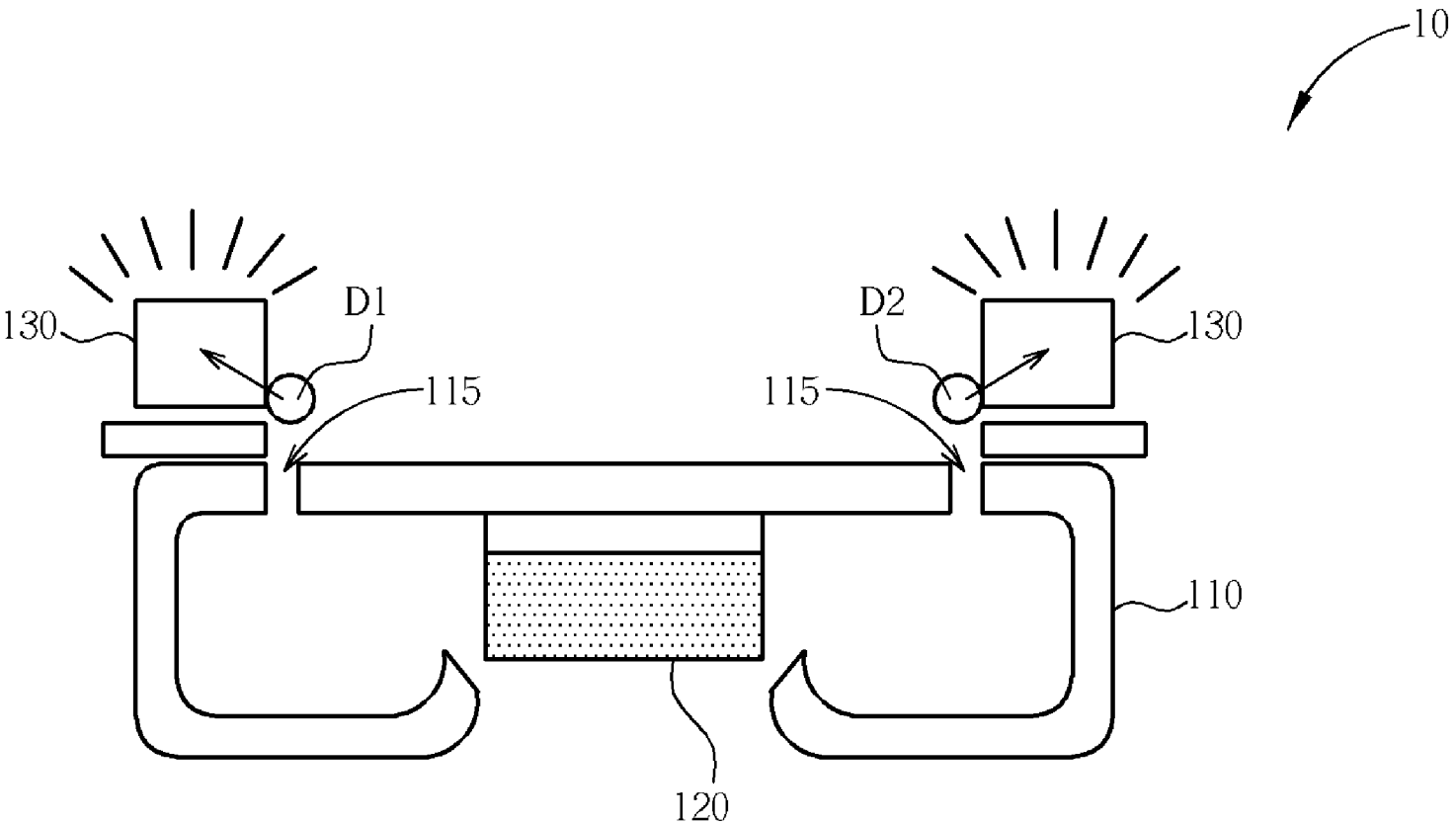
Fig. 1 Prior Art
FIG. 1 is a cross-sectional diagram of a prior art speaker capable of emitting light.
Figure 2:
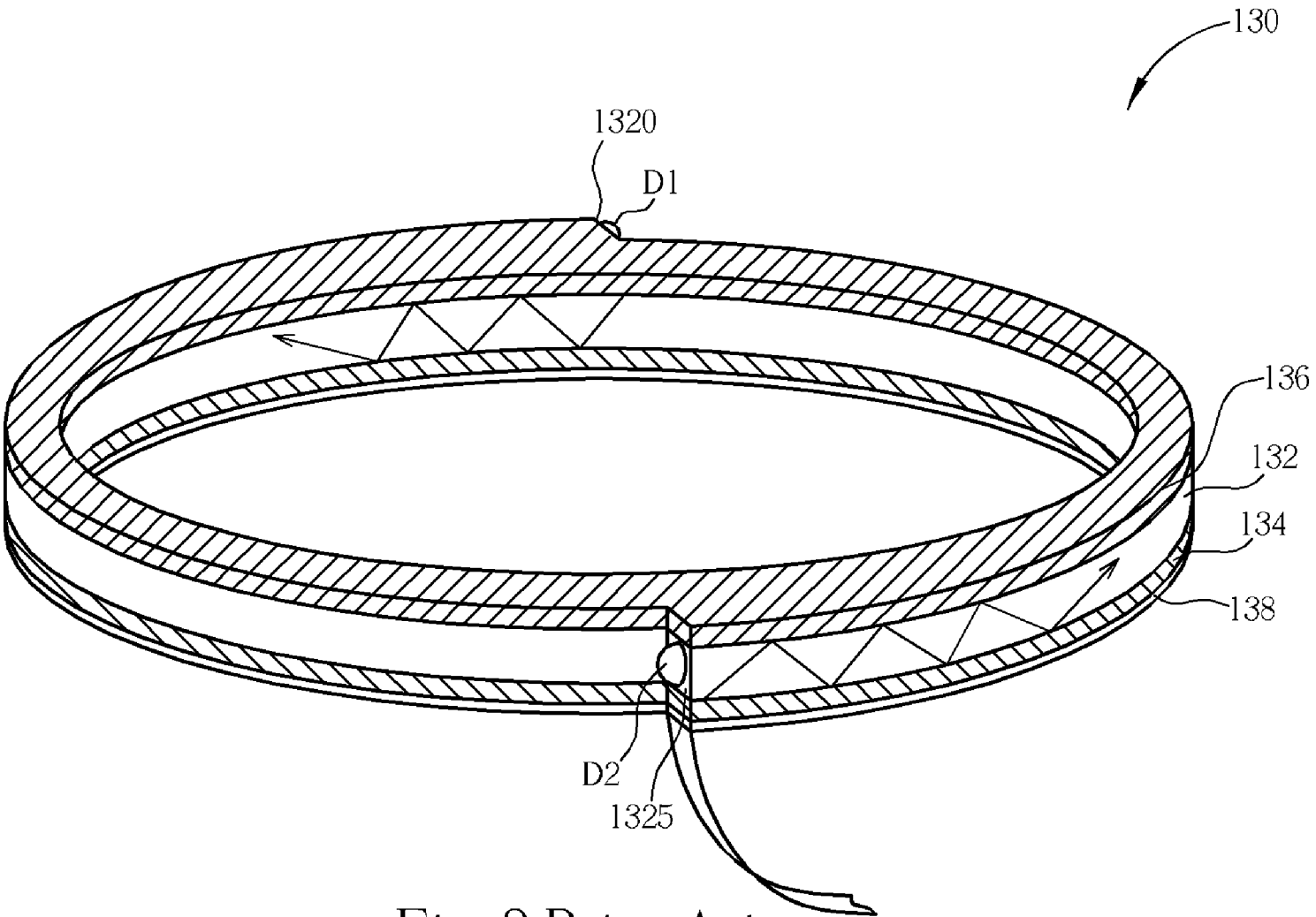
Fig. 2 Prior Art
FIG. 2 is a schematic diagram of the light pipe installed on the opening of the speaker chamber.
Figure 3:
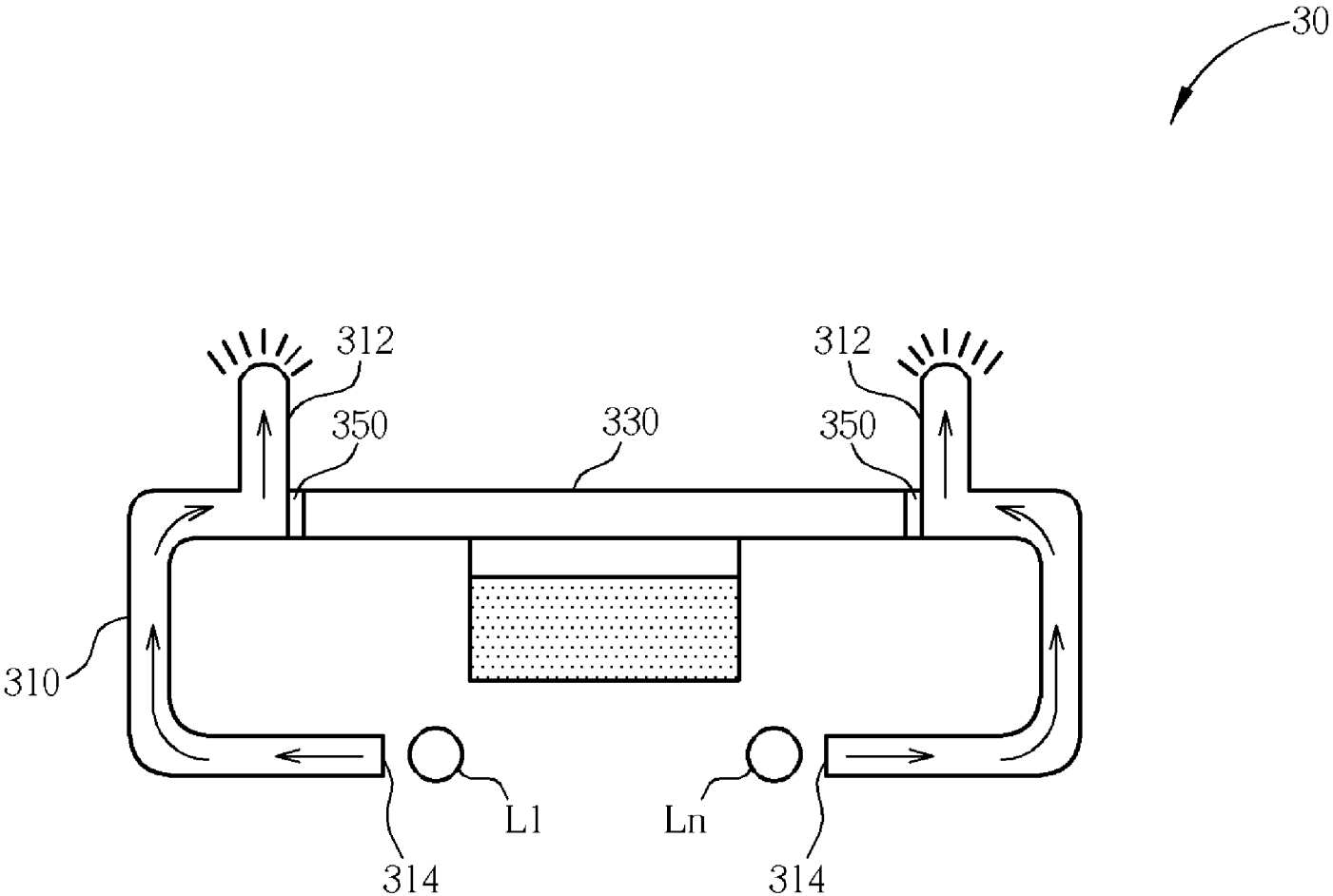
FIG. 3 is a cross-sectional schematic diagram of a speaker capable of emitting light according to an embodiment of the present invention.
Figure 4:
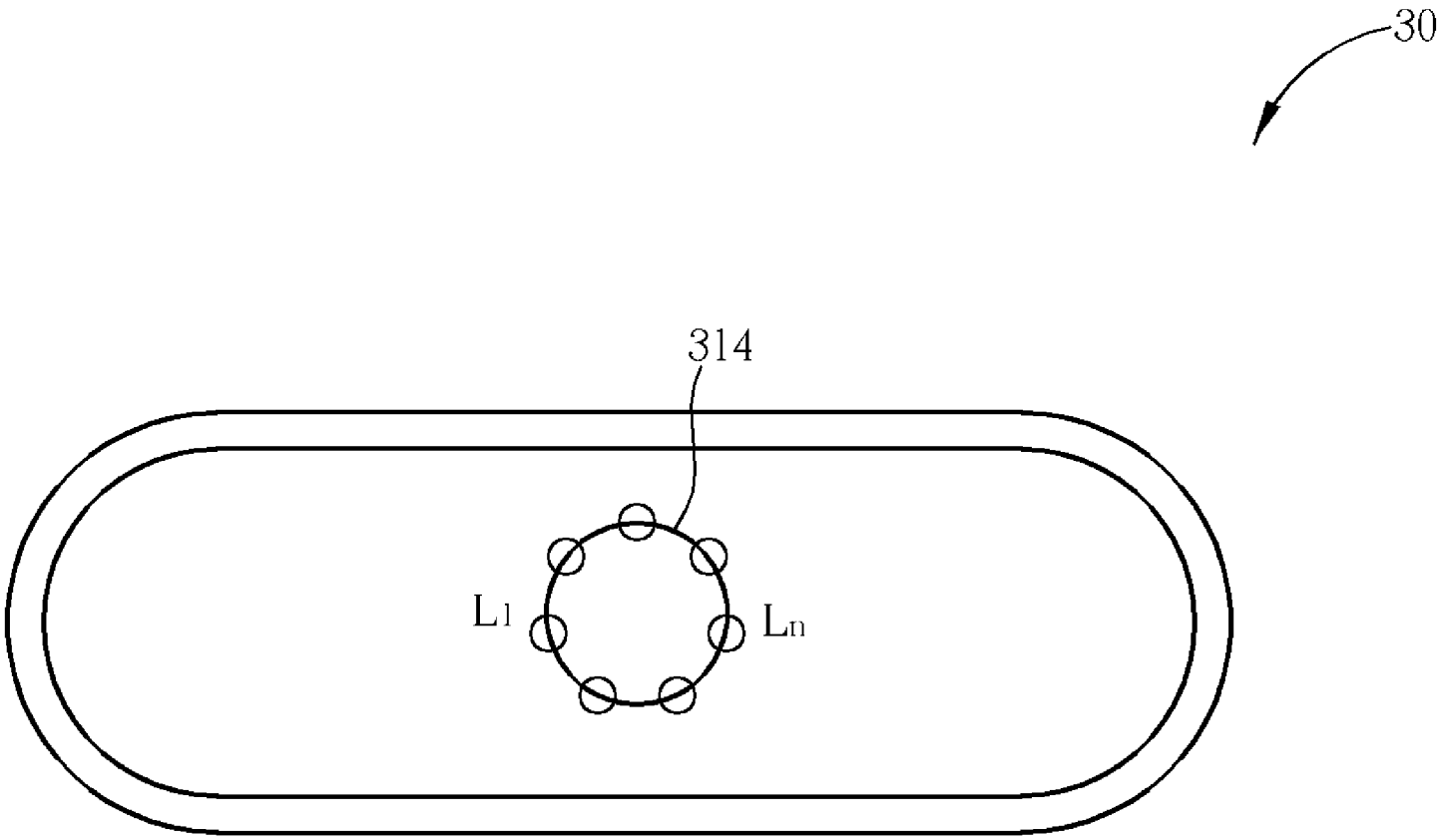
FIG. 4 is a back-view schematic diagram of the speaker of the present invention.
Figure 5:
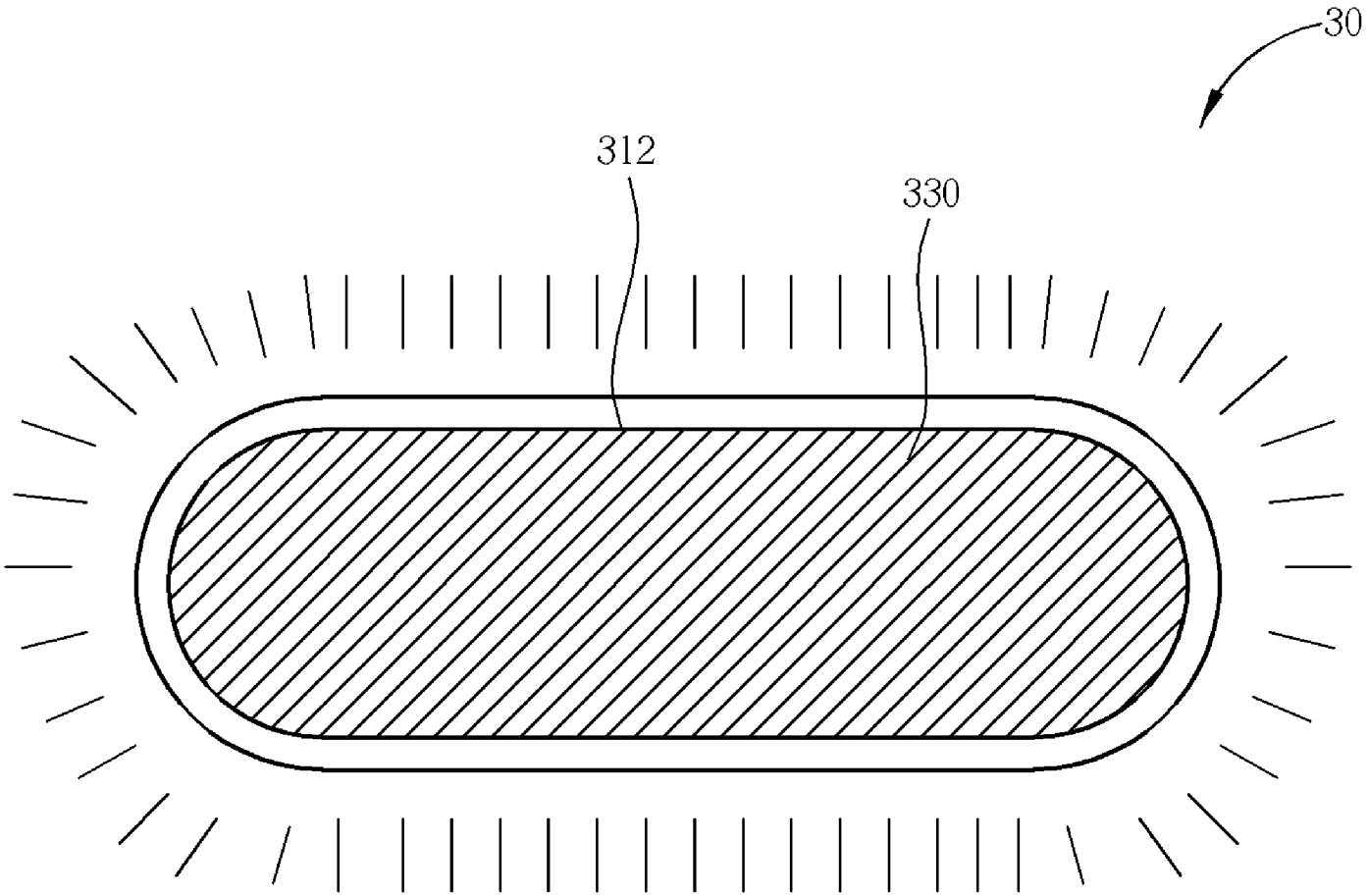
FIG. 5 is a top-view schematic diagram of the speaker of the present invention.

Please refer to FIG. 3, FIG. 4 and FIG. 5. FIG. 3 is a cross-sectional schematic diagram of a speaker 30 capable of emitting light according to an embodiment of the present invention, FIG. 4 is a back-view schematic diagram of the speaker 30 of the present invention, and FIG. 5 is a top-view schematic diagram of the speaker 30 of the present invention. The speaker 30 comprises a housing 310, light generators L1~Ln and a speaker core 330. The housing 310 is formed by material capable of propagating light, and comprises a first opening 312 and a second opening 314. The light generators L1~Ln are installed nearby the second opening 314 for generating light. The speaker core 330 is installed on the first opening 312 of the housing 310, and is utilized for generating sound. Furthermore, the second opening 314 of the housing 310 is a light reception terminal for receiving light generated by the light generators L1~Ln, the first opening 312 of the housing 310 is a light emission terminal for emitting light, and the housing 310 is a light carrier for providing a light propagation path, which can be formed by transparent or semi-transparent material that is capable of propagating light, such as acrylic, glass, etc. Preferably, the housing 310 can be a speaker chamber of the speaker 30, and the light generators L1~Ln can be light emitting diodes (LED).

Therefore, in the present invention, the speaker 30 can generate sound by the speaker core 330 according to input signals. On the other hand, the speaker 30 can also propagate light generated by the light generators L1~Ln with the housing 310 formed as the speaker chamber of the speaker 30, so that the speaker 30 can have a function of emitting light.

Please refer to FIG. 3. The speaker 30 of the present invention further comprises an elastic body 350. The elastic body 350 is installed between the speaker core 330 and the first opening 312 of the housing 310, and is utilized for jointing the speaker core 330 and the housing 310 and for confining a vibration direction of the speaker core 330. Preferably, the elastic body 350 can be a foam rubber. When light is generated by the light generators L1~Ln, the light generated by the light generators L1~Ln can be received with the second opening 314 of the housing 310. Then, the light is propagated through the housing 310 to the first opening 312, so as to be emitted. Therefore, as shown in FIG. 3, the light generated by the light generators L1~Ln can be conducted from the second opening 314 to the first opening 312 through the housing 310, so that the light can be emitted evenly from the first opening 312. Please note that a shape of the housing 310 is merely an exemplary embodiment of the present invention, and those skilled in the art can make appropriate modifications according to practical demands, which all belong to the category of the present invention. Moreover, the light generators L1~Ln can be further coupled to a control circuit (not shown in the figure). The control circuit can control intensity or frequency of the light generated by the light generators L1~Ln according to signals inputted to the speaker core 330.

Compared with the prior art, the speaker capable of emitting light according to the present invention does not need to utilize extra light pipes, and directly utilizes the speaker chamber of the speaker for providing the light generators with a light propagation path to achieve an equal light emitting function. Therefore, the present invention can reduce usage of related components, such as diffusers and reflectors, so that the production cost and the thickness can be saved, and thus is suitable for the current electronic devices of small sizes and light weight. Moreover, compared with the prior art that utilizes reflectors for reflecting the light propagating in the light pipe, the present invention directly propagates and emits light through the speaker chamber, so that light emission efficiency of the present invention is higher than that of the prior art.

Figure 6:
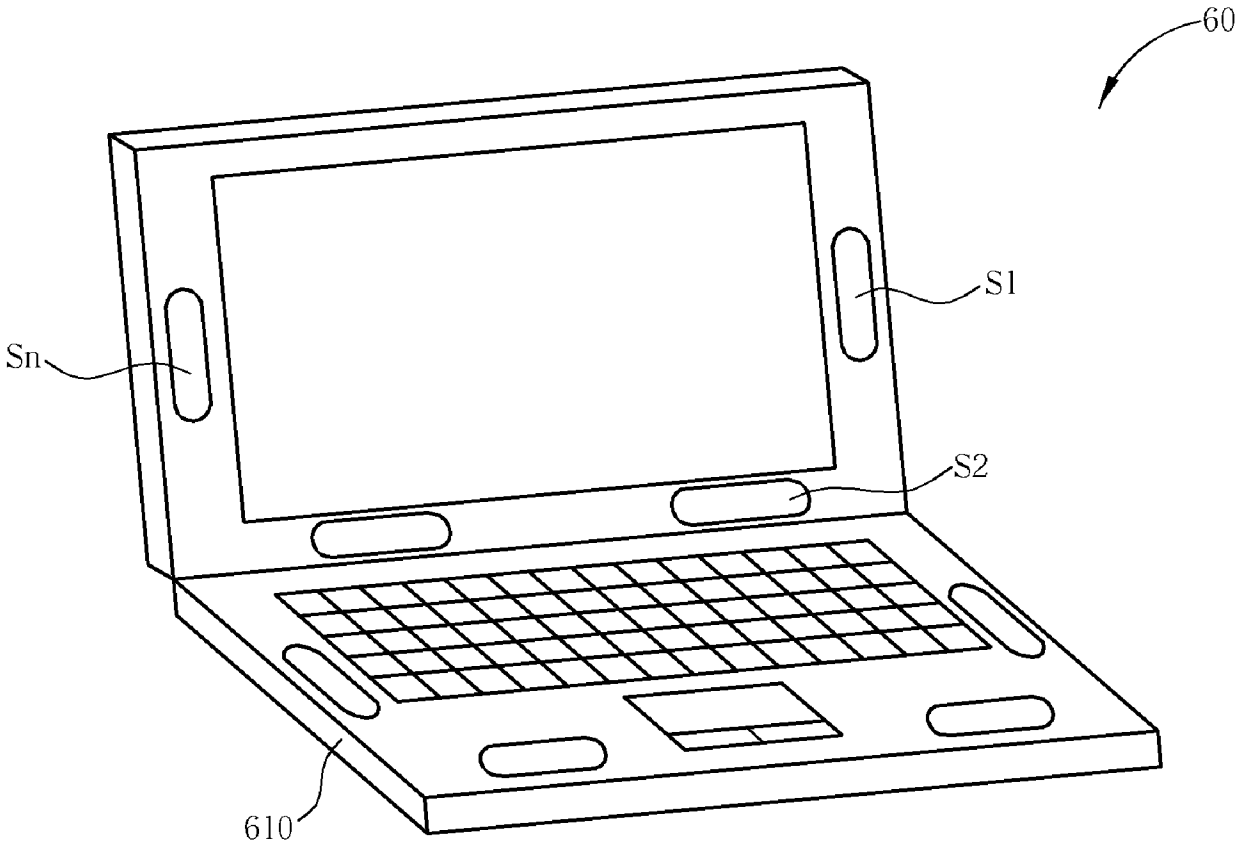
FIG. 6 is a schematic diagram of a multimedia device with speakers capable of emitting light according to an embodiment of the present invention.

Please refer to FIG. 6, which is a schematic diagram of a multimedia device 60 with speakers capable of emitting light according to an embodiment of the present invention. The multimedia device 60 comprises a multimedia processing system 610 and speakers S1~Sn. As shown in FIG. 6, the multimedia device 60 preferably is a notebook computer. The multimedia processing system 610 is utilized for processing multimedia signals. The speakers S1~Sn are installed on the multimedia device 60, and are utilized for outputting processing results of the multimedia processing system 610. Each of the speakers S1~Sn is the speaker 30 capable of emitting light shown in FIG. 3. Hence, not only can the speakers S1~Sn generate sound according to the processing results of the multimedia processing system 610, but also can generate light corresponding to the sound generated by the speakers. Therefore, with the multimedia device 60, the sound can be heard and 'seen' as well by users. Please note that the multimedia device with speakers capable of emitting light of the present invention is not restricted to a notebook computer, and can be a desktop computer, a mobile communication device, or audio equipment.

As mentioned above, the speaker capable of emitting light of the present invention utilizes a housing formed as a speaker chamber of the speaker and for conducting light generated by light generators, so as to have a function of emitting light. Furthermore, the present invention can reduce usage of related components, such as diffusers and reflectors, so that the production cost and the thickness can be saved, and thus is suitable for the current electronic devices of small sizes and light weight.

Those skilled in the art will readily observe that numerous modifications and alterations of the device and method may be made while retaining the teachings of the invention.

What is claimed is:

1. A speaker capable of emitting light comprising:
- a housing formed by material capable of propagating light comprising a first opening and a second opening;
- a plurality of light generators formed nearby the second opening of the housing for generating light; and
- a speaker core set in the first opening of the housing for generating sound;
- wherein the housing comprises:
  - a light reception terminal set on the second opening for receiving light generated by the plurality of light generators;
  - a light emission terminal set on the first opening for emitting light; and
  - a carrier coupled between the light reception terminal and the light emission terminal for providing a light propagation path.

2. The speaker of claim 1, wherein the light reception terminal corresponds to a periphery of the second opening of the housing.

3. The speaker of claim 1, wherein the light emission terminal corresponds to a periphery of the first opening of the housing.

4. The speaker of claim 1, wherein the housing is formed as a speaker chamber of the speaker.

5. The speaker of claim 1, wherein the housing is transparent.

6. The speaker of claim 1, wherein the housing is semi-transparent.

7. The speaker of claim 1, wherein the plurality of light generators are a plurality of light emitting diodes.

8. The speaker of claim 1, wherein the speaker further comprises an elastic body set between the speaker core and the first opening of the housing for jointing the speaker core and the housing.

9. The speaker of claim 8, wherein the elastic body is further utilized for confining a vibration direction of the speaker core.

10. A multimedia device with speakers capable of emitting light comprising:
- a multimedia processing system for processing multimedia signals; and
- a plurality of speakers for outputting processing results of the multimedia processing system, wherein each speaker comprises:
  - a housing formed by material capable of propagating light comprising a first opening and a second opening;
  - a plurality of light generators formed nearby the second opening of the housing for generating light; and
  - a speaker core set in the first opening of the housing for generating sound;
  - wherein the housing of the speaker comprises:
    - a light reception terminal set on the second opening for receiving light generated by the plurality of light generators;
    - a light emission terminal set on the first opening for emitting light; and a carrier coupled between the light reception terminal and the light emission terminal for providing a light propagation path.

11. The multimedia device of claim 10, wherein the light reception terminal corresponds to a periphery of the second opening of the housing.

12. The multimedia device of claim 10, wherein the light emission terminal corresponds to a periphery of the first opening of the housing.

13. The multimedia device of claim 10, wherein the housing is formed as a speaker chamber of the speaker.

14. The multimedia device of claim 10, wherein the housing is transparent.

15. The multimedia device of claim 10, wherein the housing is semi-transparent.

16. The multimedia device of claim 10, wherein the plurality of light generators are a plurality of light emitting diodes.

17. The multimedia device of claim 10, wherein the plurality of light generators of the speaker are coupled to a control circuit, which is utilized for controlling the plurality of light generators to generate light according to the processing results of the multimedia processing system.

18. The multimedia device of claim 10, wherein the speaker further comprises an elastic body set between the speaker core and the first opening of the housing for jointing the speaker core and the housing.

19. The multimedia device of claim 18, wherein the elastic body is further utilized for confining a vibration direction of the speaker core.

* * * * *